US005816160A

United States Patent [19]

Taira et al.

[11] Patent Number: 5,816,160

[45] Date of Patent: Oct. 6, 1998

[54] STAMP UNIT CAPABLE OF DETACHABLY HOLDING STAMP PLATE FORMED WITH STAMP IMAGE

[75] Inventors: Hiroshi Taira; Mitsunobu Suda, both of Ichinomiya, Japan

[73] Assignee: Brother Kogyo Kabushiki Kaisha, Nagoya, Japan

[21] Appl. No.: 854,346

[22] Filed: May 12, 1997

[30] Foreign Application Priority Data

May 14, 1996 [JP] Japan ..... 8-119087

[51] Int. Cl.[6] ..... B41K 1/56

[52] U.S. Cl. ..... 101/405; 101/327; 101/382.1; 101/383

[58] Field of Search ..... 101/379, 405, 101/406, 327, 333, 334, 382.1, 383

[56] References Cited

U.S. PATENT DOCUMENTS

| | | | |
|---|---|---|---|
| 624,020 | 5/1899 | Heany | 101/379 |
| 768,981 | 8/1904 | Duncan | 101/379 |
| 880,225 | 2/1908 | Lamb et al. | 101/379 |
| 1,069,356 | 8/1913 | Tilden | 101/379 |
| 1,920,058 | 7/1933 | Buck | 101/379 |
| 3,282,209 | 11/1966 | Muskin . | |
| 3,817,178 | 6/1974 | Hagen | 101/379 |
| 3,973,495 | 8/1976 | Rowe . | |
| 4,172,419 | 10/1979 | Munyon | 101/379 |
| 5,123,349 | 6/1992 | Beaver et al. | 101/379 |
| 5,577,444 | 11/1996 | Toyama | 101/379 |

FOREIGN PATENT DOCUMENTS

| | | | |
|---|---|---|---|
| B-386-805 | 10/1988 | Austria . | |
| 662078 | 4/1963 | Canada | 101/379 |
| A1-0-644-059 | 3/1995 | European Pat. Off. . | |
| A-05-058015 | 7/1993 | Japan . | |
| A-7251558 | 10/1995 | Japan . | |
| 406432 | 3/1934 | United Kingdom | 101/379 |
| 1088681 | 6/1965 | United Kingdom | 101/379 |

*Primary Examiner*—Eugene H. Eickholt
*Attorney, Agent, or Firm*—Oliff & Berridge, PLC

[57] ABSTRACT

In order to prevent a stamp plate or a stencil plate from falling off or shifting on. a stamp unit, and to simplify operations for exchanging the stamp plate (stencil plate) during stamping operations or stencil-producing operations, a support body is formed with rail portions. The rail portions are C-shaped in cross section. Holding pawl portions are formed along lengthwise edges of the rail portions. The stamp plate is held in a recess of a backside reinforcement. When the stamp plate held in this manner is inserted in a space between the pair of rail portions, the holding pawl portions hold the lengthwise edge surfaces of a stamp surface of the stamp plate, and also the rail portions support the backside reinforcement so the stamp plate will not fall off.

16 Claims, 11 Drawing Sheets

STAMP UNIT CAPABLE OF DETACHABLY HOLDING STAMP PLATE FORMED WITH STAMP IMAGE

BACKGROUND OF THE INVENTION

1. Field of the Invention

The present invention relates to the configuration of a stamp unit for detachably supporting a stamp plate such as an ink-impregnated sponge.

2. Description of the Related Art

Japanese Laid-Open Patent Application No. HEI-7-251558 discloses a conventional stamp plate formed on its stamp surface with mirror images of characters, such as figures and characters. The mirror images will produce a stamp image when the stamp plate is pressed against a recording medium. Because this type of stamp plate is thin, soft, and easy to bend, the back surface of the stamp plate, that is, the opposite side from the stamp surface, is adhered with adhesive to a flat base in the same manner as conventional rubber stamps. The back surface of the stamp plate can be adhered to the flat base either directly or through layers of ink-absorbent pads adhered to the under surface of the base. A handle of the stamp unit is mounted on the upper surface of the base.

One method of forming mirror images of the predetermined characters on a rectangular-shaped stamp plate is to fix the stamp plate on a support body and move the stamp surface of the stamp plate across a thermal head. However, to use this method, the stamp plate has to be easily detachable from the support body.

SUMMARY OF THE INVENTION

Once the stamp plate is fixed by adhesive to the base, it is difficult to remove the stamp plate from the base. When the adhesive is strong, the stamp plate may be torn when being removed.

Further, as disclosed in the prior art, it is extremely easy to form mirror images of a predetermined character on this type of stamp plate. This advantage can be utilized by forming different mirror images, for example, in the manner described above, on a plurality of stamp plates and then exchanging the stamp plates used with the same stamp unit as needed. In this way, only one stamp unit need be provided to produce a variety of difference stamp images. However, to use the image forming method described above, the stamp plate has to be easily detachable from the support body. Also, the stamp plates can not be freely exchanged if they are adhered to the stamp unit using adhesive.

It is an objective of the present invention to overcome the above-described problems and to provide a stamp unit wherein a stamp plate is easily detachable from a support body.

In order to achieve these and other objectives, a stamp unit according to the present invention includes: a flat plate-shaped stamp plate formed from a plastic foam base plate filled with open cells, the stamp plate having a stamp surface and a backside surface opposite the stamp surface, the stamp surface exposing open cells through which ink can be transmitted, the stamp surface being capable of being melted and fused to produce a melted-fused portion which blocks transmission of ink therethrough; a support body that supports the stamp plate from its backside surface; and a backside reinforcement that is freely, detachably disposed between the stamp plate and the support body, the backside reinforcement holding the stamp plate.

According to another aspect of the present invention, a stamp unit includes: a flat plate-shaped stamp plate formed from a plastic foam base plate filled with open cells, the stamp plate having a stamp surface and a backside surface opposite the stamp surface, the stamp surface exposing open cells through which ink can be transmitted, the stamp surface being capable of being melted and fused to produce a melted-fused portion which blocks transmission of ink therethrough; a support body having a support surface that supports the backside surface of the stamp plate, at least one of the stamp plate and the support body being provided with holding members penetrating into at least one of the backside surface of the stamp plate and the support surface of the support member to detachably hold the stamp plate to the support body.

BRIEF DESCRIPTION OF THE DRAWINGS

The above and other objects, features and advantages of the invention will become more apparent from reading the following description of the preferred embodiment taken in connection with the accompanying drawings in which:

FIG. 6 (*b*) is a perspective view showing operations for mounting the backside reinforcement and the stamp plate to a support body of the first embodiment;

FIG. 14 (*b*) is a side view in partial cross section showing the complete stamp unit of the fourth embodiment when mounting operations are completed;

DETAILED DESCRIPTION OF THE PREFERRED EMBODIMENTS

Figure 1:
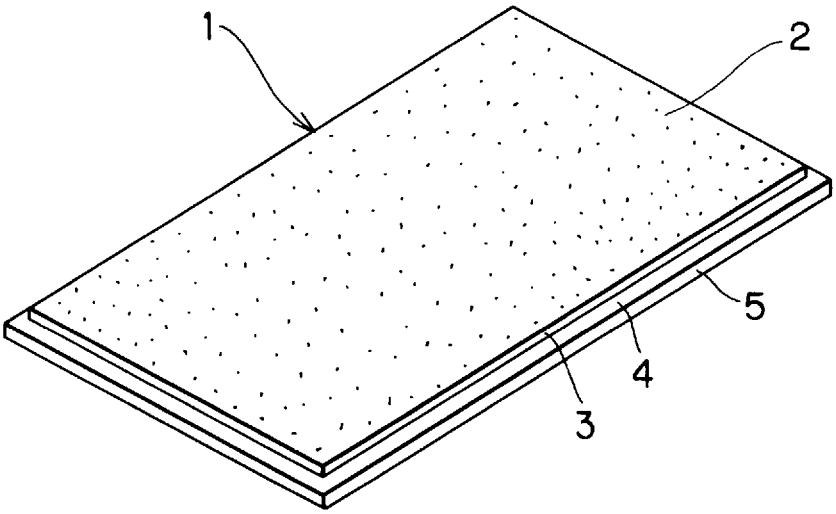
FIG. 1 is a perspective view showing a stamp plate according to a first embodiment of the present invention.

A printing device according to preferred embodiments of the present invention will be described while referring to the accompanying drawings wherein like parts and components are designated by the same reference numerals to avoid duplicating description. It should be noted that, unless otherwise mentioned, directional terms such as back, front, up, and down will be used to refer to the device when oriented in a posture in which it is intended to be used.

Next, an explanation will be provided for a first embodiment of the present invention. FIG. 1 is a perspective view showing a stamp plate 1 formed from a plastic foam base plate filled with open cells. As will be described below, the four side surfaces of the stamp plate 1 are covered with a thin film which blocks transmission of ink. However, the open cells are exposed in the broad front and back surfaces, so that ink can be transmitted through these surfaces. The original plastic foam base plate is formed from a hard or semi-hard polyolefin resin having minute open cells. The original base plate can instead be formed from a polyurethane resin, a vinyl chloride resin, an ABS resin, an ethylene-vinyl acetate copolymer, or other plastic foams having minute open cells. In order to expose the open cells, in the stamp surface, after expansion these plastic foams may sliced into flat plate shapes so as to remove the outer layer covering the open cells. Alternatively, the plastic foams can be expanded in a mold and the surface which abuts the mold can be used as the stamp surface.

As shown in FIG. 1, in the present embodiment the stamp plate 1 has a stamp surface 2 having exposed cells in a predetermined area on a protruding upper surface of the stamp plate 1. The remaining portions 3, 4, 5, that is, the four side surfaces of the stamp plate 1 and the wide under surface, have been pressed against a heated mold to melt and fuse the cells, thereby covering the portions 3, 4, 5 with a thin film layer that blocks transmission of ink. The portions 3, 4, 5 can be otherwise referred to as melted-fused portions. It should be noted that when the back surface, that is, the under surface as viewed in FIG. 1, is left as an ink-transmitting non-melted-fused portion, ink can supplied to the stamp surface 2 for a long period of time during consecutive stamp printing operations by layering ink absorbent pads on the back surface of the stamp plate 1.

Figure 2:
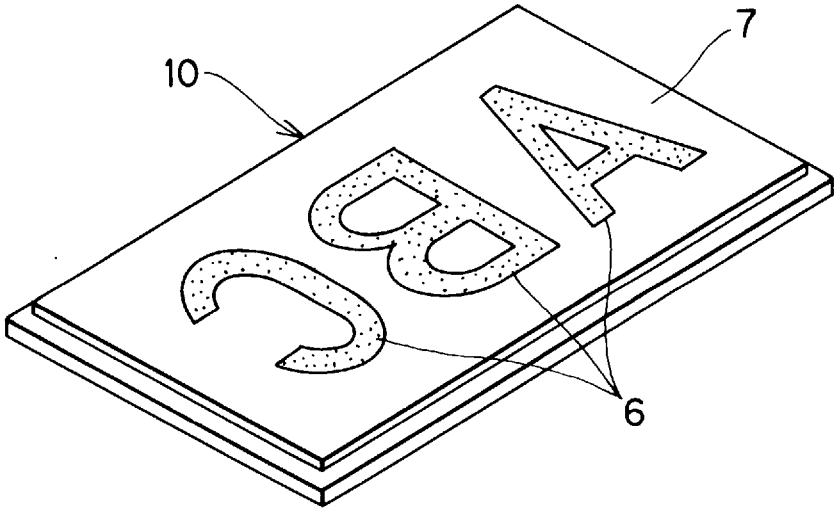
FIG. 2 is a perspective view showing a stencil plate formed from the stamp plate of Fig. 1.

FIG. 2 is a perspective view showing a stencil plate 10 formed with an image portion 6 in the stamp surface 2 of the stamp plate 1. The image portion 6 forms a mirror image of an image to be stamped, such as characters or figures. To form the image portion 6, the stamp plate 1 is attached to the under surface of a stamp unit 11 to be described later, and the stamp unit 11 is mounted in a stamp producing device 60 shown in FIGS. 3 to 5. The stamp producing device 60 is then used to form the image portion.

Next, an explanation will be provided for configuration of the stamp producing device 60. The stamp producing device 60 includes a guide rod 64 and a head switching rod 67, both extending horizontally between left and right edge walls 61*a*, 61*b* of a frame 61. The guide rod 64 and the head switching rod 67 are for supporting and guiding a carriage 63 movably in the horizontal direction. The head switching rod 67 is also for operating a cam body 66 to move a thermal head 65 mounted on the carriage 63 upward and downward as will be described later. The cam body 66 is mounted on the head switching rod 67 so as to be unrotatable around the rod 67, but slidable in an axial direction of the rod 67. The head switching rod 67 is freely, rotatably supported by bearings 73 provided to the left and right edge walls 61*a*, 61*b*.

Figure 4:
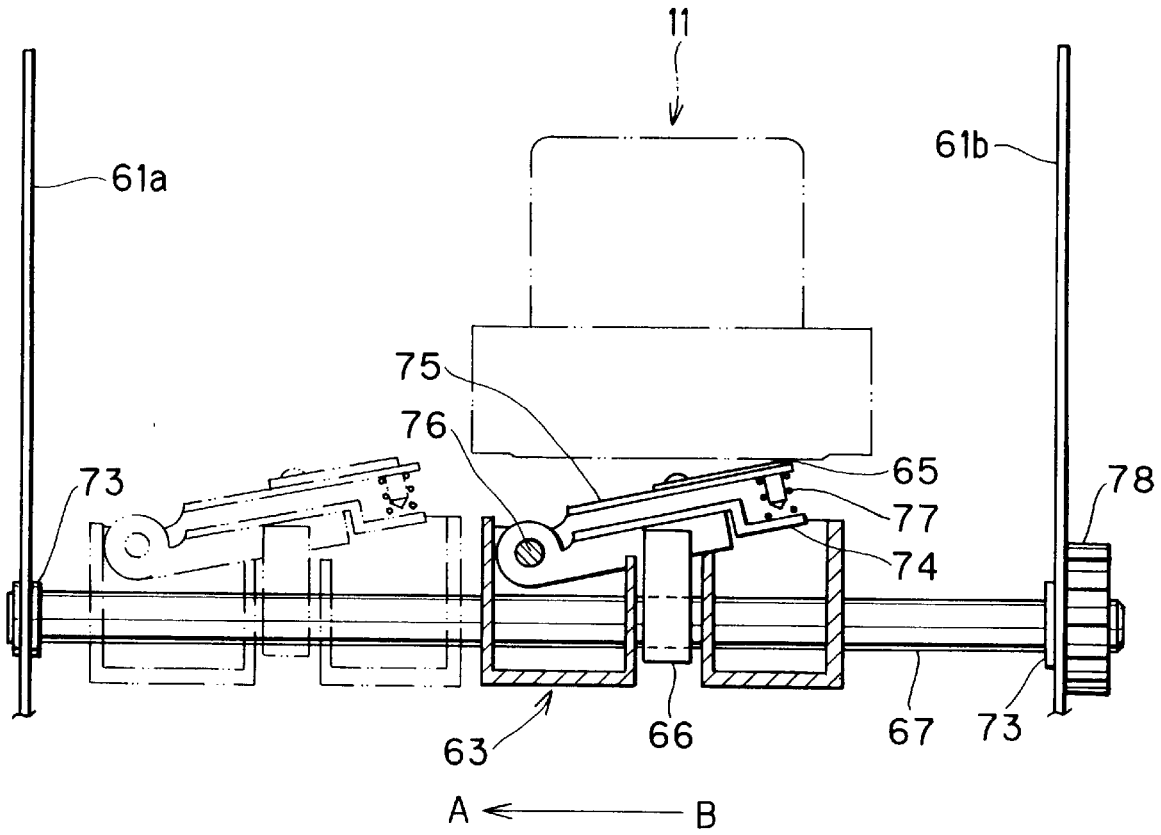
FIG. 4 is a cross-sectional view of the stencil-plate producing device taken along line IV—IV of FIG. 3.
Figure 5:
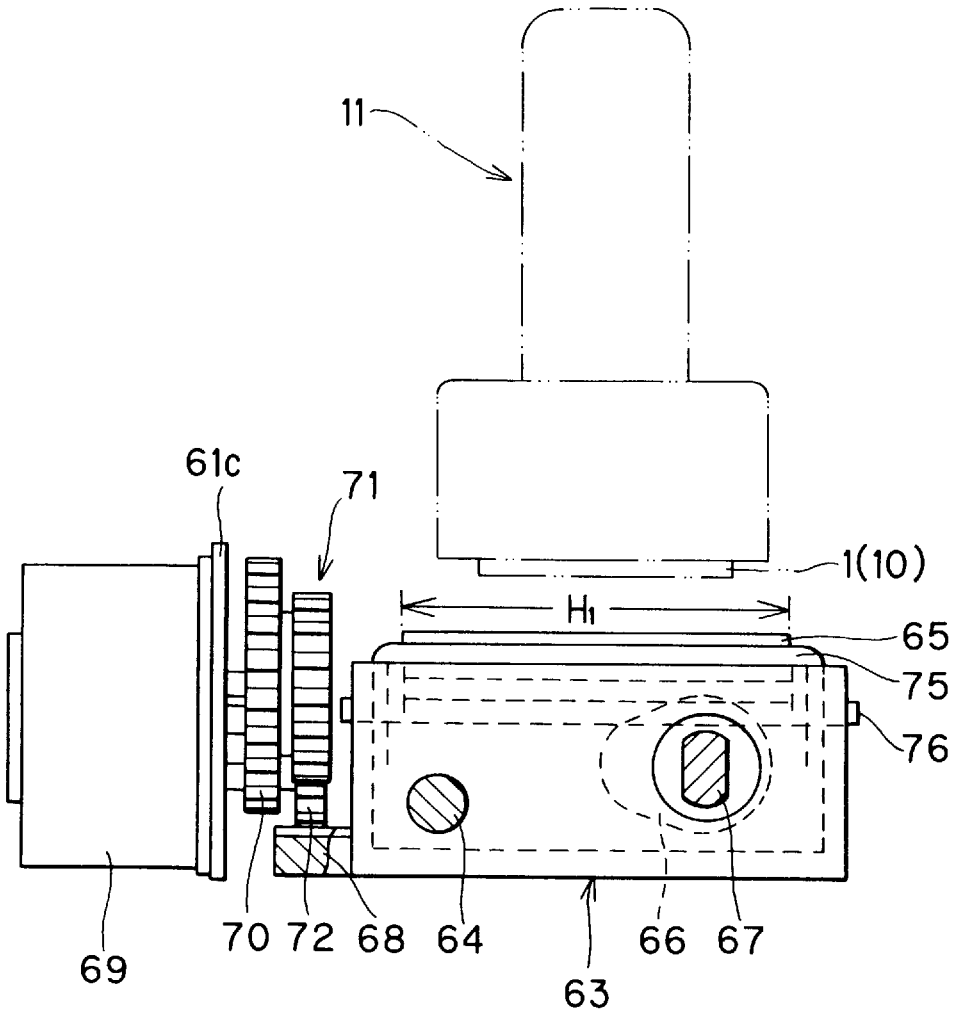
FIG. 5 is a cross-sectional view of the stencil-plate producing device taken along line V—V of FIG. 3.

Here, an explanation will be provided for the drive mechanism of the carriage 63. As shown in FIG. 5, a rack 68 extending leftward and rightward to an appropriate length is fixed, either integrally or via some appropriate fixing means, to the ,front edge of the carriage 63. A drive motor 69 rotatable in forward and reverse directions is fixed to a front surface wall 61*c* of the frame 61. The drive motor 69 has a drive pinion 70. A deceleration gear group 71 engaged with the drive pinion 70 is provided to the back surface of the front surface wall 61*c*. The deceleration gear group 71 has a meshing gear engaged with the rack 68. The drive pinion 70 transmits drive force to the meshing gear 72 via the deceleration gear group 71 so that the carriage 63 can be moved in leftward and rightward directions, that is, in directions indicated by arrows A and B in FIGS. 3 and 4.

Next, an explanation will be provided for mechanism for forming the image portion on the stamp plate 1. As shown in phantom in FIGS. 4 and 5, the stamp unit 11 is supported in the stamp producing device 60 at a position above where the carriage 63 passes, by a support means not shown in the drawings. A support shaft 76 is disposed in the carriage 63 so as to extend perpendicular to the head switching rod 67. A cam abutting plate 74 and a head heat-radiating plate 75 are mounted on the carriage 63 so as to be pivotable upward and downward on the support shaft 76. An urging spring 77 for constantly and elastically urging the head heat-radiating plate 75 upward is inserted between the upper surface of the cam abutting plate 74 and the back surface of the head heat-radiating plate 75. The cam body 66 is formed in an oval shape and is positioned so as to abut the lower surface of the cam abutting plate 74.

The thermal head 65 is fixed at the upper edge of the upper surface of the head heat-radiating plate 75. The thermal head 65 has the same configuration as a thermal head used in a conventional, well-known thermal printer. For example, 96 dot-shaped thermal elements can be juxtaposed on the thermal head 65 in a line perpendicular to the arrow A of FIG. 3. The line of thermal elements is slightly longer than the width of the stamp plate 1. Said differently, the head heat-radiating plate 75 is formed to a width H1 equivalent to the length of the line of dot-shaped thermal elements of the thermal head 65, but slightly wider than the width of the stamp surface 2.

Figure 3:
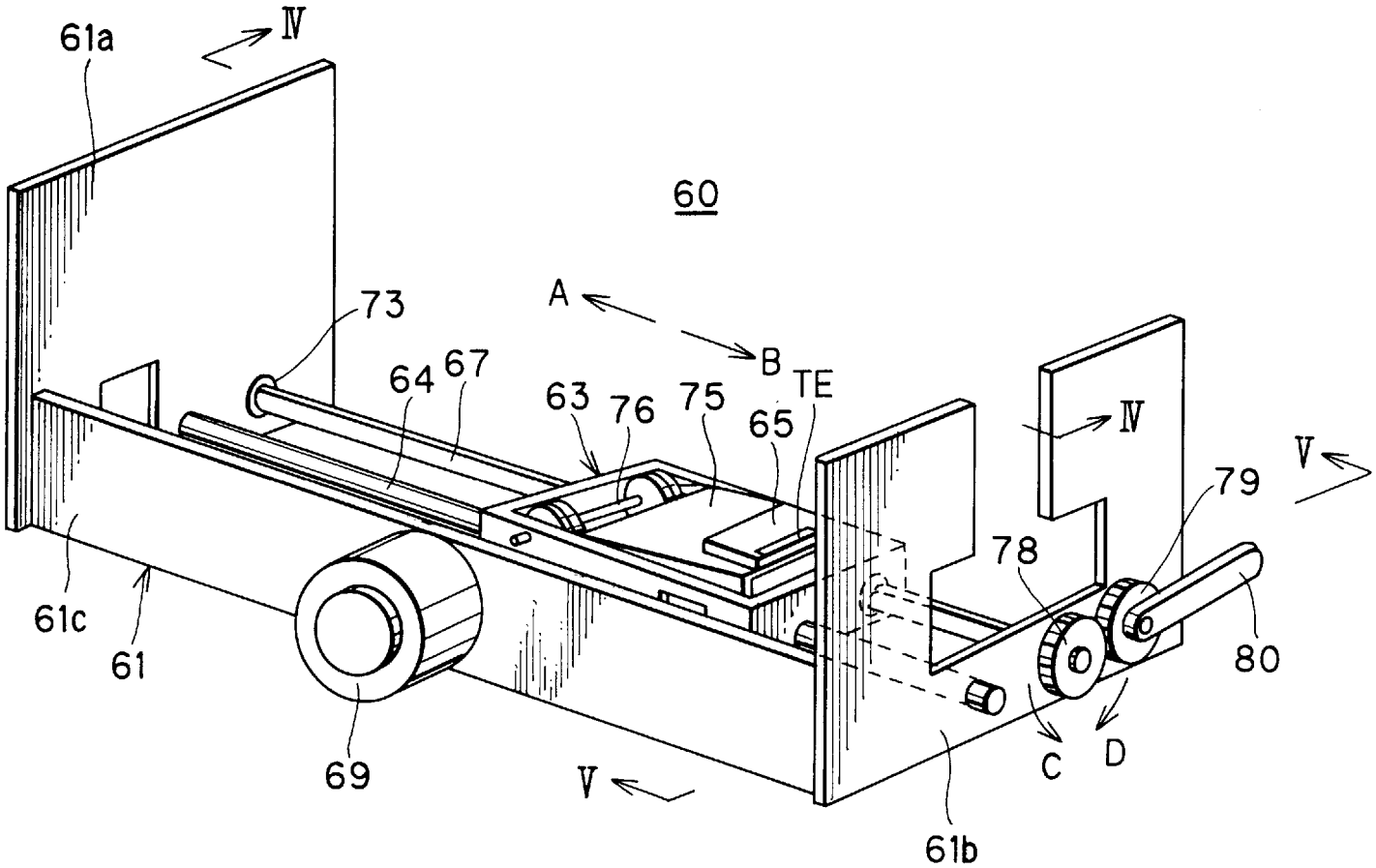
FIG. 3 is a perspective view showing an essential portion of a stencil-plate producing device.

As shown in FIG. 3, a gear 78 is attached to the exposed tip of the head switching rod 67. A gear 79 supported on the right edge wall 61*b* is in meshing engagement with the gear 78. A lever 80 for rotating these gears 78, 79 is attached to the same rotational shaft as the gear 79. By rotating the lever 80, the head switching rod 67 can be rotated in the directions of the arrows C or D in FIG. 3, thereby changing the posture of the cam body 66. When the cam body 66 is rotated into a reclining posture, the head heat-radiating plate 75 to which the thermal head 65 is attached is released downward. When the cam body 66 is rotated into an upright posture, the head heat-radiating plate 75 is pivoted upward via the cam abutting plate 74 and the urging spring 77 so that the thermal head 65 abuts the lower surface of the stamp plate 1, which is supported thereabove as described above.

The stamp producing device 60 has a control unit, such as a microcomputer not shown in the drawings. The control unit includes, for example: a central processing unit (CPU); a read-only memory (ROM); a random-access memory (RAM); and an interface. The control unit controls to raise the cam body 66 so that the thermal head 65 is urged against the right edge portion of the stamp surface 2, which faces downward from the stamp plate 1. The control unit then drives the drive motor 69 so that the carriage 63 will move in the direction of arrow A in FIG. 4 at a fixed speed.

Simultaneously with this, the control unit also selectively drives, based on preinputted predetermined character data, the line of dot-shaped thermal elements on the thermal head 65. As a result, selected portions of the stamp surface 2 are melted and fused to form a thin film for blocking transmission of ink, that is, the non-ink transmitting melted-fused portion 7. The image portion 6 formed with a mirror image of predetermined characters is formed by non-melted-fused portions of the stamp surface 2. In this way, the stencil plate 10 is produced.

Figure 6A:
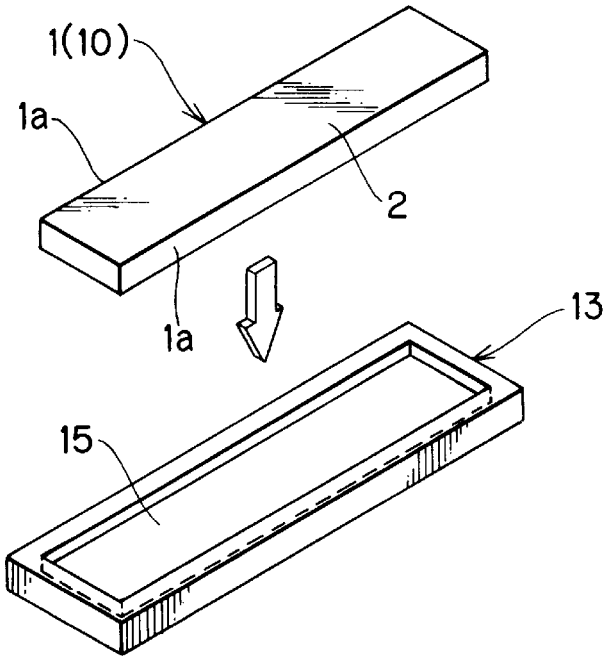
FIG. 6 (*a*) is a perspective view showing the stamp plate and a backside reinforcement of a stamp unit according to the first embodiment.
Figure 6B:
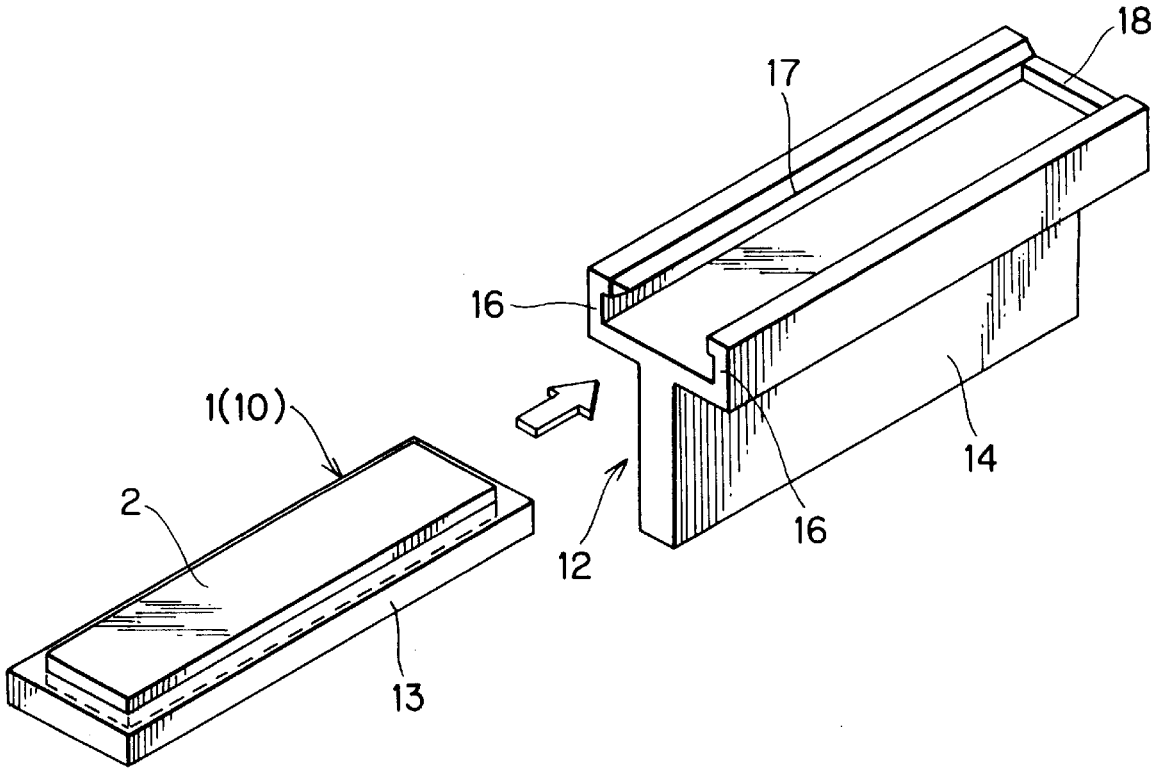

Next, configuration of the stamp unit 11 will be explained. FIGS. 6 (*a*) through 8 show the stamp unit 11 according to a first embodiment of the present invention. The stamp unit 11 includes: the stamp plate 1; a rectangular-shaped backside reinforcement 13 for supporting the back surface of the stamp plate 1; and a support body 12 formed integrally with or separately from a handle portion 14. It should be noted that although the stamp plate 1 is shown in FIG. 6 (*a*) as having a rectangular plate shape when viewed from above, the stamp plate is actually formed with the shape shown in FIG. 1. The backside reinforcement 13 is formed at its front surface side with a recess 15 having the same rectangular shape as the stamp plate 1 when viewed from above. The stamp plate 1 is inserted into the recess 15 to be fixed in position on the backside reinforcement 13.

According to the first embodiment, a pair of rail portions 16, 16 are disposed at the front surface side of the support body 12 so as to extend in parallel with the side surfaces of the stamp plate 1. The pair of rail portions 16, 16 have L shapes in cross section. The backside reinforcement 13 is slidably inserted lengthwise between the rail portions 16, 16 and the front surface of the support body 12. In this way, the rail portions 16, 16 hold the backside reinforcement 13 between themselves and the front surface of the support body 12, thereby preventing the backside reinforcement from falling off the support body 12. Holding pawl portions 17, 17 are provided at the edges of the pair of rail portions 16, 16 following the lengthwise direction of the pair of rail portions 16, 16. The holding pawl portions 17, 17 are formed either integrally with or separately from the pair of rail portions 16, 16. The holding pawl portions 17, 17 elastically hold side surfaces 1*a*, 1*a* of the stamp plate 1 or corner portions of the stamp surface 2 of the stamp plate 1.

It should be noted that the support body 12 may be formed from a compound resin. The holding pawl portions 17, 17 can be configured from an elastic material such as a rubber. Tip portions (free tip portions) of each holding pawl portion 17 can be formed into substantially triangular shapes or arched shapes facing toward each other.

Figure 8:
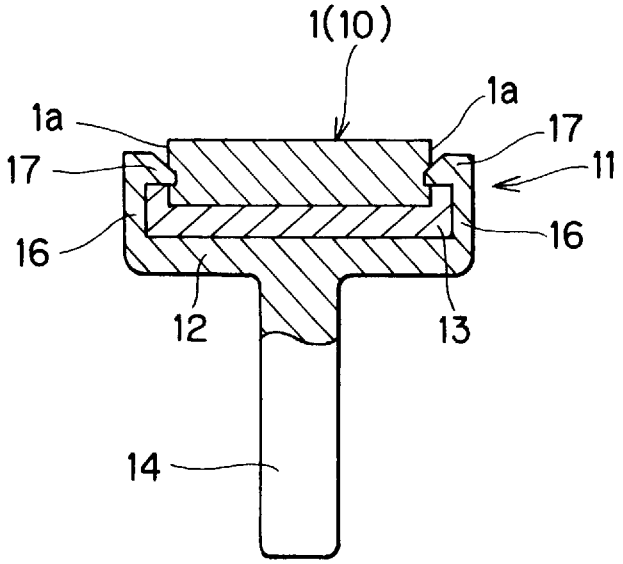
FIG. 8 is a view in partial cross section showing the stamp unit taken along line VIII—VIII of FIG. 7.

The free tip portions of the holding pawls 17, 17 are separated by a distance set slightly narrower than a width of the stamp plate 1, or more specifically, than a distance between the left and right side surfaces la, la of the stamp plate 1. In the present embodiment, the holding pawls 17, 17 are disposed near the front surface of the support body 12 as shown in FIG. 8. With this configuration, the holding pawls 17, 17 can hold the side surfaces la, la of the stamp plate 1 by pinching them from both left and right sides. Alternatively, the holding pawls 17, 17 can be disposed at the surface of, the stamp plate 1 whereon the stamp surface 2 attached. In this case, the holding pawls 17, 17 and the front surface of the support body 12 sandwich the stamp surface 2 at corner portions thereof in its lengthwise, thereby holding the corner portions in position.

It should be noted that the pair of rail portions 16, 16 and the holding pawls 17, 17 may be formed along the entire length of the side surfaces 1*a*, 1*a* of the stamp plate 1 as shown in FIG. 6 (*a*), or may be formed along only a part of the length. Also, a stopper 18 for positioning the inserted backside reinforcement 13 can be disposed at one edge of the support body 12 so as to connect the rail portions 16, 16 together.

In order to mount the stamp plate 1 to the stamp unit 11, as shown in FIG. 6 (*a*), first, the stamp plate 1 with the stamp surface 2 facing upward is inserted into the recess 15 of the backside reinforcement 13. Then, as shown in FIG. 6 (*b*), the backside reinforcement 13 is horizontally slid between the rail portions 16, 16 and the support body while the stamp unit 11 is disposed with the handle portion 14 facing downward.

Figure 7:
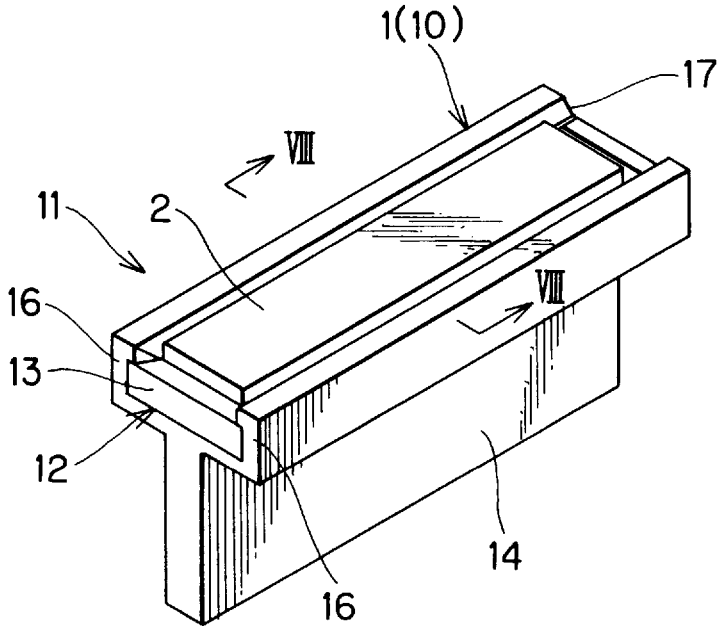
FIG. 7 is a perspective view showing the stamp unit when mounting operations are completed.

As a result, as shown in FIGS. 7 and 8, the pair of rail portions 16, 16 prevent the backside reinforcement 13 from falling out of the support body 12. Also the holding pawls 17, 17 formed to the edge of the rail portions 16 sandwich and hold the side surfaces 1*a*, 1*a* of the stamp plate 1 in the backside reinforcement 13 so that the stamp plate 1 is held in place and will not fall out of the backside reinforcement 13. Under this condition, the stamp surface 2 of the stamp plate 1 protrudes slightly above the upper surface of the holding pawls 17, 17. By mounting the stamp plate 1 to the stamp unit 11, fixing the stamp unit 11 at the predetermined portion of the stamp producing device 60, and executing the above-described operations for producing a stencil plate, then a stamp formed with the melted-fused portion 7, which does not transmit ink, and the non-melted-fused portion, which transmits ink, can be easily formed on the stamp surface 2 of the stamp plate 1. It should be noted that when the stamp surface 2 is melted and fused, the thin film layer at the melted-fused portion 7 is more dense that the surrounding non-melted-fused portions. Therefore, the image portion 6 protrudes slightly higher than the ink-blocking melted-fused portion 7 so that an image produced by the stamp is clear.

Because the head heat-radiating plate 75 is formed to a width H1, all portions of the stamp surface 2, except for the image portion 6, will be melted and fused to form the melted-fused portion 7 so that ink can be prevented from seeping from the stamp surface 2 except at the image portion 6.

Figure 9:
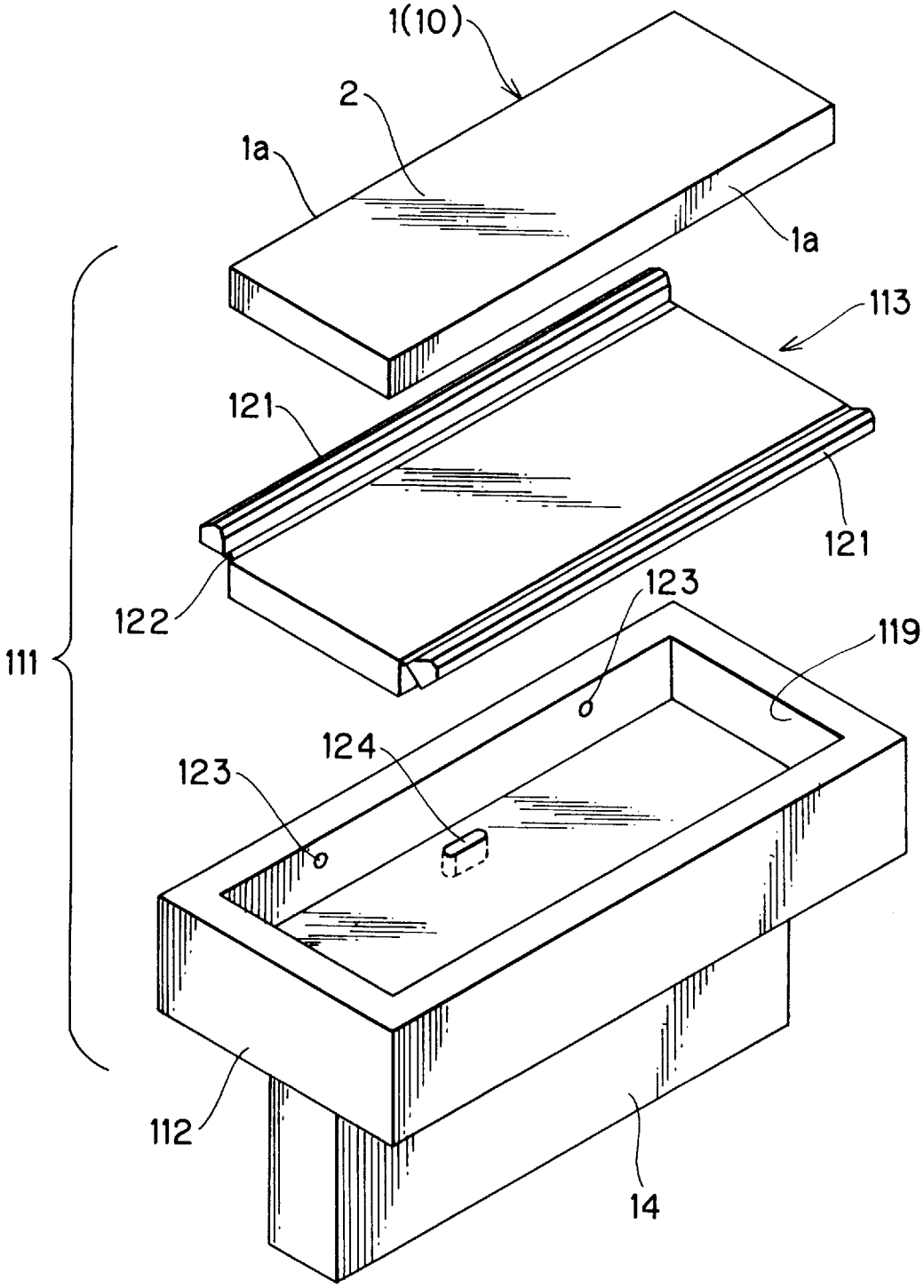
FIG. 9 is an exploded perspective view showing components of a stamp unit according to a second embodiment.
Figure 10:
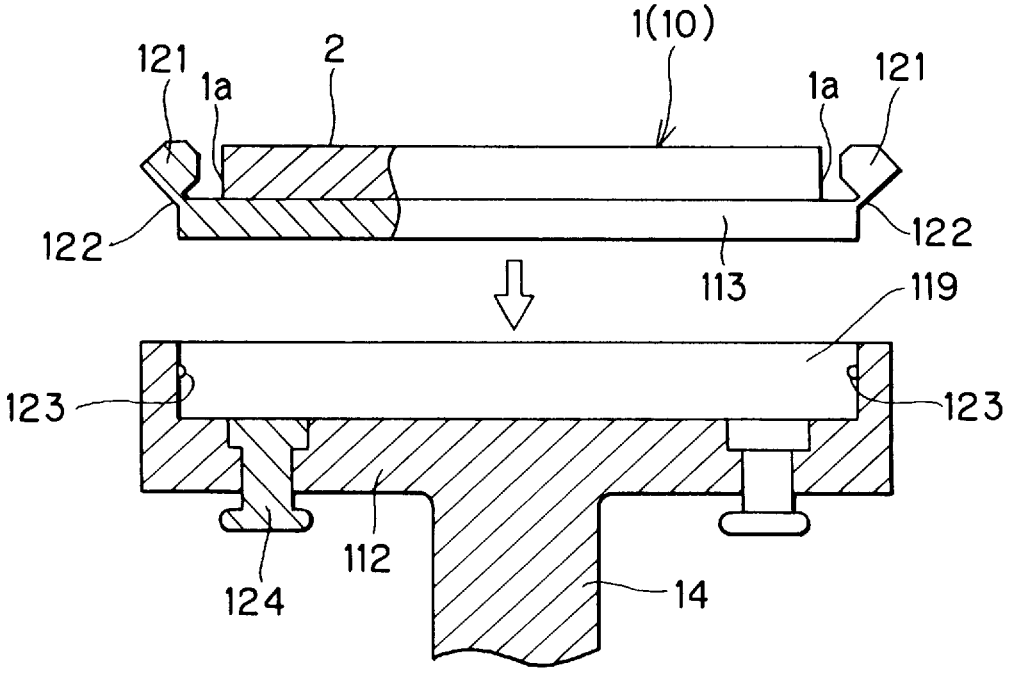
FIG. 10 is a cross-sectional view showing operations for mounting a backside reinforcement and a stamp plate to a support body of the second embodiment.
Figure 11:
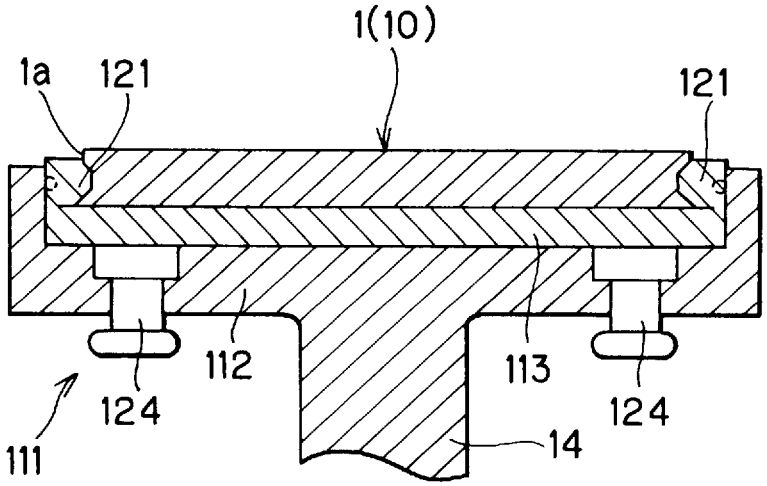
FIG. 11 is a cross-sectional view showing the stamp unit of the second embodiment when mounting operations are completed.

FIGS. 9 through 11 show a stamp unit 111 according to a second embodiment of the present invention. The stamp unit 111 includes: the stamp plate 1, a backside reinforcement 113, and a support body 112. The backside reinforcement 113 is for supporting the back surface of the stamp plate 1. Freely bendable connecting portions 122, 122 are attached to the backside reinforcement 113 and a pair of holding pawls 121, 121 are connected to the connecting portions 122, 122. The backside reinforcement 113, the holding pawls 121, and the connecting portions 122 can be integrally formed from a compound resin using injection molding.

The support body 112 is formed on its back surface side with the handle portion 14 and on its front surface side with a recess 119 for fitting the stamp plate 1 and the backside reinforcement 113 together therein. Small protrusions 123 are provided at a plurality of positions on the vertical inner walls of the recess 119. One or a plurality of pushers 124 for pushing the backside reinforcement 113 out of the recess 119 are provided in the recess 119 of the support body 112.

With this configuration, as shown in FIGS. 9 and 10, first, the stamp plate 1 is placed onto the front surface of the backside reinforcement 113. The holding pawls 121, 121 are moved toward each other in order to temporarily hold the side surfaces ,1*a*, 1*a* of the stamp plate 1. Next, by pushing the backside reinforcement 113 into the recess 119 formed with the support body 112, the small protrusions 123 press the outer surface of the holding pawls 121, 121 so that, as shown in FIG. 11, the stamp plate 1 along with the backside reinforcement 113 can be mounted in the recess of the support body 112.

Said differently, the holding pawls 121, 121 are bendable between the first position shown in FIG. 10 and the second position shown in FIG. 11. While in the first position, the holding pawls 121, 121 are separated between their confronting surfaces by a distance wider than the width of the stamp plate so that the stamp plate 1 is released. While in the second position, the holding pawls 121, 121 are separated between their confronting surfaces by a distance narrower than the width of the stamp plate 1 so that the stamp plate 1 is pinched therebetween.

The recess 119 of the support body 113 is formed to a width slightly narrower than the distance between the opposite facing surfaces of the holding pawls 121, 121 when the holding pawls 121, 121 are in the second position. Therefore, as shown in FIG. 11, the sides of the recess 119, and more specifically the protrusions 123, bend the holding pawls 121, 121 into their first position when the backside reinforcement is inserted into the recess of the support body.

The stamp plate 1 and the backside reinforcement 113 can be easily pushed out from the recess 119 by pushing the pushers 124. At this time, the holding pawls 121, Holding pawls 121 can easily be released from the side surfaces 1*a*, 1*a*. It should be noted the holding pawls 121, Holding paws 121 need not be formed to the backside reinforcement 113 to follow the entire lengthwise side edges of the stamp plate 1, but could instead be formed so as to follow only a portion of the lengthwise side edges.

Figure 12:
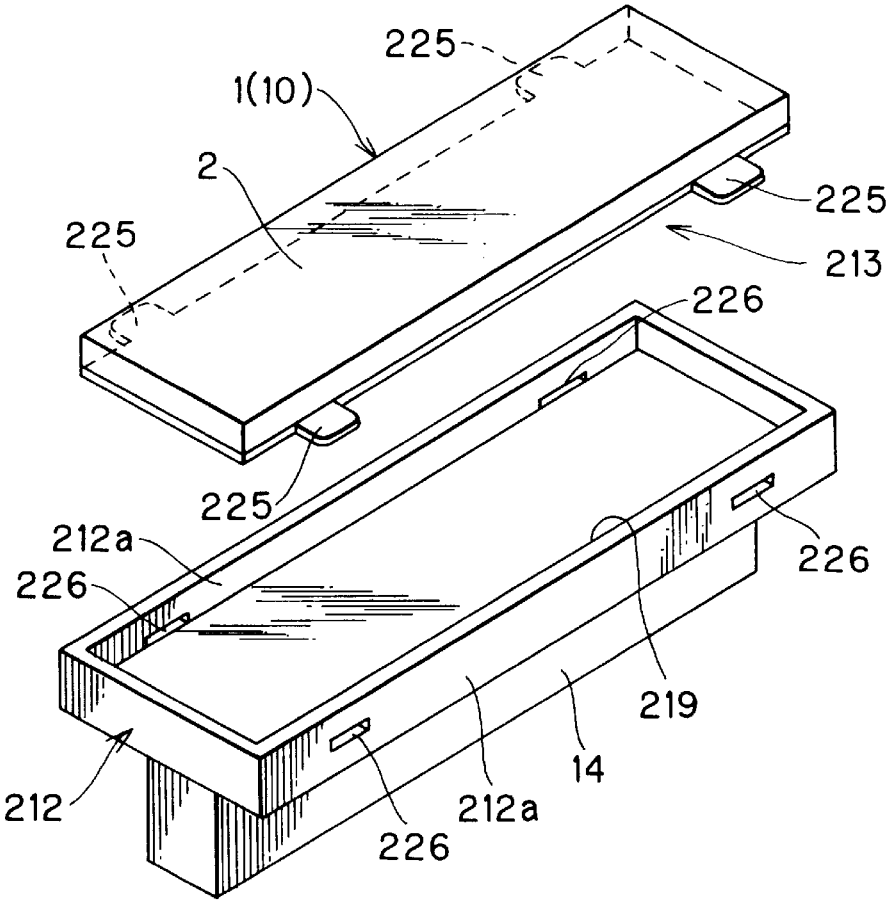
FIG. 12 is an exploded view showing components of a stamp unit according to a third embodiment.
Figure 13:
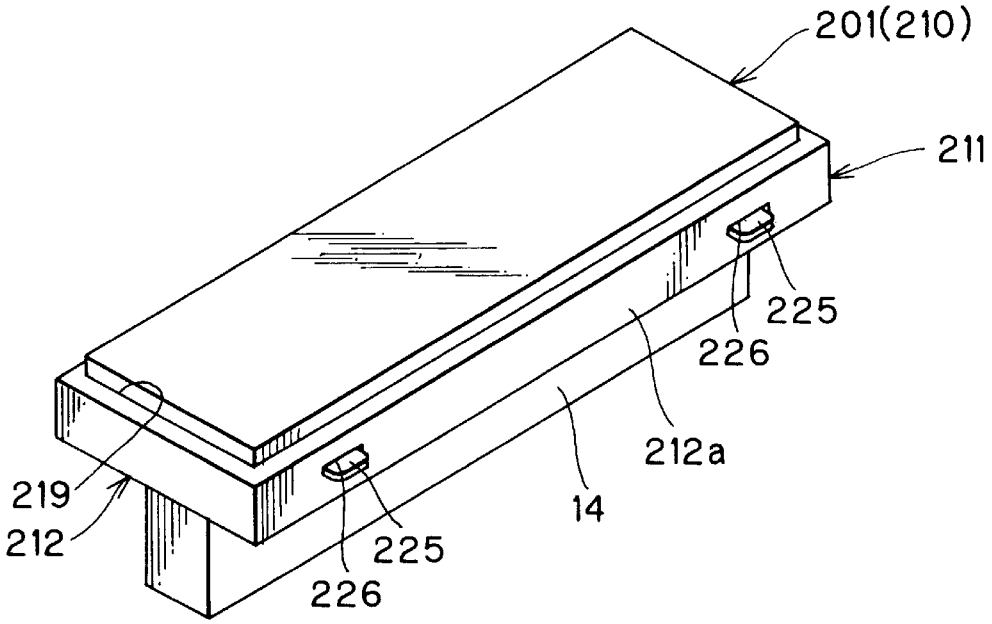
FIG. 13 is a perspective view showing the stamp unit when mounting operations are completed.

FIGS. 12 and 13 show a stamp unit 211 according to a third embodiment of the present invention. The stamp unit 211 includes the stamp plate 1, a backside reinforcement 213, and a support body 212. The backside reinforcement 213 is formed into a rectangular, thin plate from a semi-hard compound resin. The backside reinforcement 213 is fixed by adhesive to the substantially rectangular-shaped back surface of the stamp plate 1. Four flat holding pawls 225 are formed integrally with the lengthwise side edges of the backside reinforcement 213 and between the backside reinforcement 213 and the support body 212. The flat holding pawls 225 extend outward away from each other and in parallel with the surface of the stamp plate 1 fixed to the backside reinforcement 213. It should be noted that more or less than four flat holding pawls 225 could be provided to the backside reinforcement 213.

The support body 212 is provided on its back surface side with the handle portion 14, and formed in its front surface side with a recess 219. The recess 219 is formed into a substantially rectangular shape for fitting the stamp plate 1 and the backside reinforcement 213 therein. Holding apertures 126 are provided in the side walls 212*a* of the support body 212 so as to penetrate substantially horizontally from the inner surface of the recess 219 through the side walls 212*a*.

With this configuration, in order to insert the stamp plate 1 and the backside reinforcement 213 into the recess 219, first, the user bends the backside reinforcement 213 so that the flat holding pawls 125 slant slightly downward. Then, the user guides each flat holding pawl 225 adjacent to corresponding ones of the apertures 226 and inserts the flat holding pawls 225 into the corresponding holding apertures 226. By releasing the backside reinforcement 213, the stamp plate 1 returns to its flat shape by elasticity of the backside reinforcement 213 and, as shown in FIG. 13, is properly held in a position in the support body 212.

In order to detach the stamp plate 1 and the backside reinforcement 213 from the support body 212, the flat holding pawls 225 protruding out from the side walls 212*a* of the support body 212 are pushed back through the holding apertures 226 so that the backside reinforcement 213 and the stamp surface 2 of the stamp plate 1 are deformed into an arched shape and the backside reinforcement 213 and the stamp plate 1 can be detached. In this way, the flat holding pawls 225 serve in both holding and releasing the backside reinforcement 213 and the support body 212.

According to the present embodiment, the stamp plate 1 and the backside reinforcement 213 may be fixed together before supply to a user, or the user may fix them together when needed.

Figure 14A:
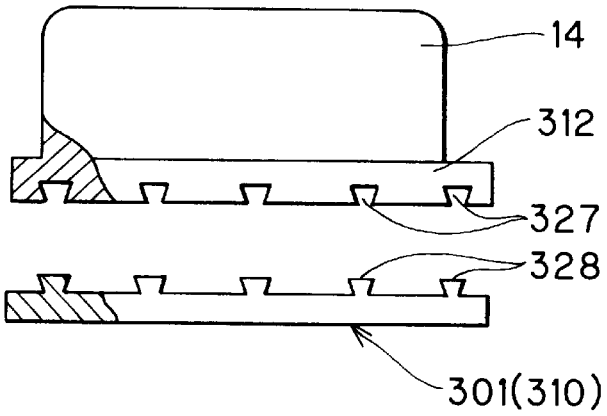
FIG. 14 (*a*) is an exploded view in partial cross section showing components of a stamp unit according to a fourth embodiment of the present invention.
Figure 14B:
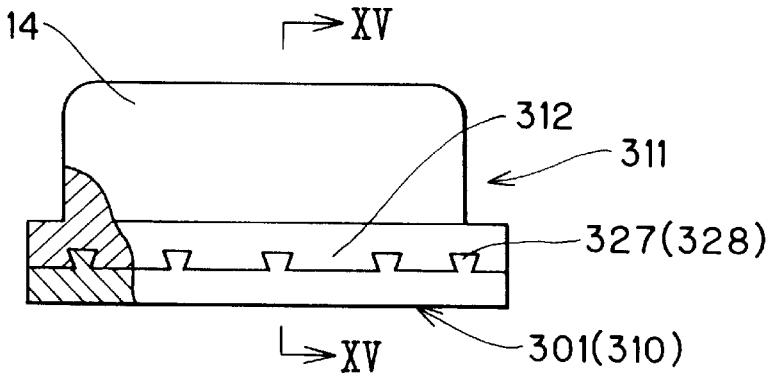
Figure 15:
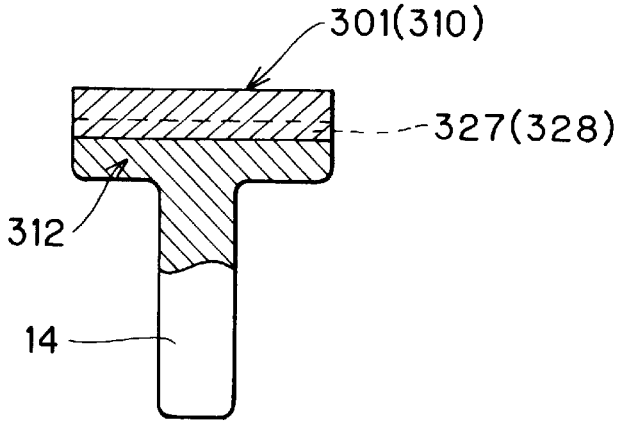
FIG. 15 is a cross-sectional view taken along line XV—XV of FIG. 14.

FIGS. 14 (*a*), 14 (*b*), and 15 show a stamp unit 311 according to a fourth embodiment of the present invention. The stamp unit 311 includes a stamp plate 310 and a support body 312. The support body 312 is provided on its back surface with the handle portion 14 and on its front surface, which is substantially rectangular shaped, with a plurality of butterfly mortises 327. The butterfly mortises 327 extend across the front surface of the support body 312 in parallel with each other and in perpendicular to the lengthwise direction of the support body 312.

The stamp plate 301 is formed in its back surface with a plurality of parallel extending butterfly tenons 328, which are engageable with the butterfly mortises 327. It should be noted that the butterfly tenons 328 could alternatively be formed on a compound-resin backside reinforcement (not shown in the drawings) attached to the back surface of the stamp plate 301.

With this configuration, by horizontally sliding the stamp plate 301 onto the front surface of the support body 312 so that the butterfly tenons 328 engage the butterfly mortises 327, the stamp plate 301 can be prevented from shifting or falling off the support body 312.

Figure 16:
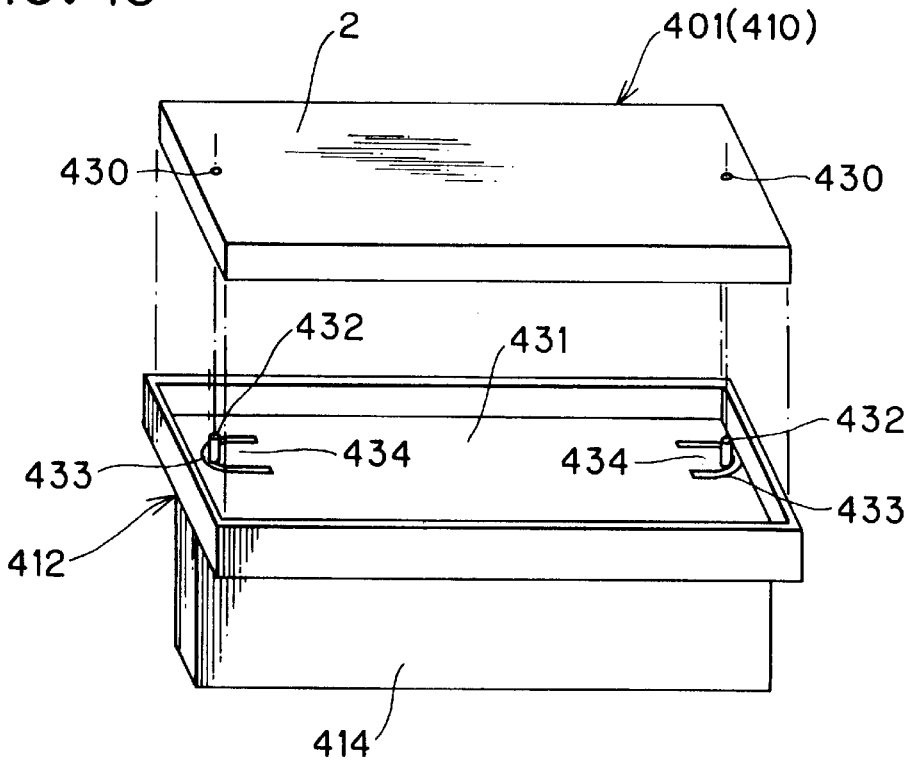
FIG. 16 is an exploded perspective view showing components of a stamp unit according to a fifth embodiment of the present invention.
Figure 17:
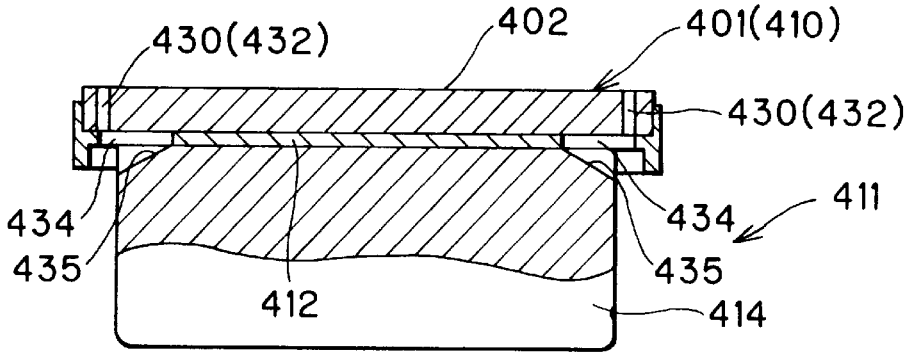
FIG. 17 is a view in partial cross section showing the stamp unit of the fifth embodiment when mounting operations are completed.
Figure 18:
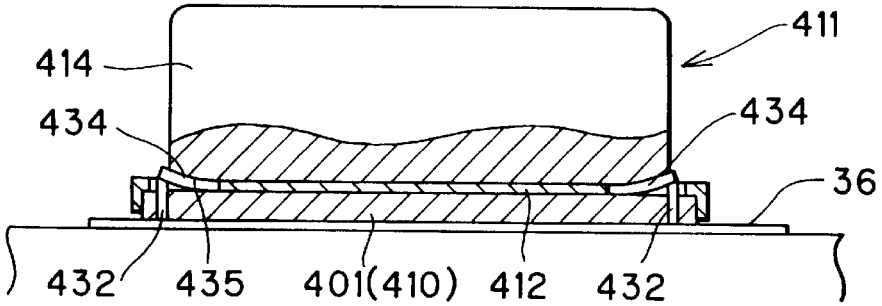
FIG. 18 is a view in partial cross section showing stamping operations using the stamp unit of the fifth embodiment.

FIGS. 16 through 18 show a stamp unit 411 according to a fifth embodiment of the present invention. The stamp unit 411 includes a stamp plate 401 and a support body 412. The stamp plate 401 has a substantially rectangular shape and is formed with at least a pair of holding holes 430. The holding holes 430 penetrate through the stamp plate 401 at portions close to lengthwise edges of the stamp plate 410.

The support body 412 is provided on its back surface with a handle portion 414. The support body 412 is formed on its substantially rectangular-shaped front surface with a recess 431 for mounting the stamp plate 401 therein. It should be noted that the stamp surface 402 of the stamp plate 401 needs to protrude above the upper edge of four side walls 412*a* when the stamp plate 401 is mounted in the recess 431. Holding pins 432 protruding downward are provided on the bottom surface of the recess 431 at positions corresponding to the holding holes 430. The holding pins 432 are desirably formed to a diameter slightly larger that the diameter of the holding holes 430 so that both the holding hole 430 and the holding pins 432 fit tightly together. Substantially U-shaped cut-out grooves 433 are formed around the holding pins 432, thereby forming movable ribs 434 each with an unattached tip at its holding pin 432 side and a base elastically connected to the support body 412. In the present embodiment, the movable ribs 434 are positioned at portions where the handle portion 414 is attached to the support body 412. Therefore, as shown in FIG. 17, cut-off portions 435 are formed in the handle portion 14 so that the free tips of each movable rib 434 can freely bend toward the handle portion 414. The cut-off portions 435 need not be provided when the movable ribs 434 are not positioned at portions corresponding to the handle portion.

In order to mount the stamp plate 401 in the support body 412, the stamp plate 401 is inserted in the recess 431 of the support body 412 with the stamp surface 2 facing outward so that the holding pins 432 engage with the holding holes 430. As a result, as shown in FIG. 17, the stamp plate 401 will fit in the support body 412 without shifting or falling out. Further, by pushing the movable ribs 434 from the back of the support body 412, the stamp plate 401 will rise out of the recess 431 so that the stamp plate 401 can be easily detached.

When stamping on a recording medium 36 such as a print sheet using the stamp unit 411, the stamp surface 402 of the stamp plate 401 will be flush with as the upper edge of the side walls 412*a* of the support body 412. At this time, because the recording medium 436 presses the tips of the holding pins 432, the movable slits 434 bend toward the cutoff portions 435 so that the tips of the holding pins 432 do not interfere with stamping operations.

With the configuration of all the embodiments, by mounting the stamp plate to the support body, the stamp plate can be reliably kept in position in the support body while the thermal head and the like rub the stamp surface of the stamp plate during stamp producing operations. In this way, stamp producing operations can be reliably executed.

Also, after finishing the stamp producing operations, the first stamp plate can be removed from the support body and replaced with a new blank stamp plate. After the new stamp plate is mounted to the support body 12, the above-described stamp producing operations are repeated, so that stamp plates with optional print patterns can be easily and quickly produced.

Also, after pressing the resultant stencil plate mounted in the stamp unit onto an ink absorbent pad (not shown in the drawings), or absorbing ink through the ink-transmitting and non-melted image portion, the stencil plate may be stamped on a recording medium such as a print sheet. While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A stamp unit comprising:

a stamp plate filled with open cells, the stamp plate having a stamp surface and a backside surface opposite the stamp surface, the stamp surface exposing open cells through which ink can be transmitted, the stamp surface being meltable and fusable to produce a melted-fused portion which blocks transmission of ink therethrough;

a support body that supports the stamp plate from its backside surface; and a backside reinforcement detachably disposed between the stamp plate and the support body, the backside reinforcement holding the stamp plate.

2. A stamp unit as claimed in claim 1 wherein:

the stamp plate includes side edge surfaces on either side of the stamp surface; and the backside reinforcement includes holding members disposed in confrontation with and extending in parallel with the side edge surfaces of the stamp plate, the holding members detachably holding the side edge surfaces of the stamp plate.

3. A stamp unit as claimed in claim 2, wherein the holding members also prevent the backside reinforcement from separating from the print plate.

4. A stamp unit as claimed in claim 3, wherein:

the stamp plate is formed in a quadrilateral shape having a first width;

the backside reinforcement is formed in a quadrilateral shape having a second width wider that the first width, the backside reinforcement having on opposite sides thereof a stamp plate side and a support body side, the stamp plate side being formed with a quadrilateral recess having the first width and into which the stamp plate is fitted;

the support body further includes a backside reinforcement support surface confronting the support body side of the backside reinforcement; and the holding members are separated by a distance narrower than the first and second widths and pinch the stamp plate therebetween, the backside reinforcement being sandwiched between the holding members and the backside reinforcement support surface of the support body.

5. A stamp unit as claimed in claim 2, wherein:

the stamp plate is formed in a quadrilateral shape having a width;

the holding members include holding pawls having confronting surfaces facing each other and non-confronting surfaces facing in opposite directions, the holding pawls being bendable between:

a first position, wherein the holding pawls are separated, between their confronting surfaces, by a first distance wider than the width of the stamp plate so that the stamp plate is released and a second position, wherein the holding pawls are separated, between their confronting surfaces, by a second distance narrower than the width of the stamp plate so that the stamp plate is pinched therebetween and, between their non-confronting surfaces, by a third distance; and the support body is formed with a recess into which the backside reinforcement is inserted, the recess being formed to a width narrower than the third distance so that walls of the recess press the holding pawls into their second position.

6. A stamp unit as claimed in claim 5, wherein the support body is further formed with protrusions on the walls of the recess, the protrusions protruding into the recess and urging the holding pawls into their second position.

7. A stamp unit as claimed in claim 5, wherein:

the backside reinforcement has a stamp plate support surface confronting the stamp plate and a support body surface confronting the support body; and the support body has a backside reinforcement side confronting the support body surface of the backside reinforcement, the support body including a pusher member for popping the backside reinforcement out of the recess and provided through the backside reinforcement side so as to be movable toward and away from the backside reinforcement.

8. A stamp unit as claimed in claim 7, wherein the support body is further formed with protrusions on the walls of the recess, the protrusions protruding into the recess and urging the holding pawls into their second position.

9. A stamp unit as claimed in claim 1 wherein:

the backside reinforcement is undetachably fixed to the backside of the stamp plate; and the backside reinforcement and the support body are provided with holding members for detachably holding the backside reinforcement and the support body together.

10. A stamp unit as claimed in claim 9,. wherein:

the backside reinforcement is formed in a quadrilateral shape having a width, the backside reinforcement is flexible in its widthwise direction, the backside reinforcement being formed with flat holding pawls on its widthwise edges; and the support body is formed with a quadrilateral shaped recess having the same width as the backside reinforcement and into which the backside reinforcement is inserted, the support body being formed with slits into which the flat holding pawls of the backside reinforcement are inserted.

11. A stamp unit as claimed in claim 9, wherein the support body is formed with a through hole and the backside reinforcement is formed with a protrusion fitting in the through hole, a tip end of the protrusion being exposed via the through hole.

12. A stamp unit as claimed in claim 10, wherein the slits formed in the support body are through holes exposing tip portions of corresponding pawls inserted therein.

13. A stamp unit comprising:

a stamp plate filled with open cells, the stamp plate having a stamp surface and a backside surface opposite the stamp surface, the stamp surface exposing open cells through which ink can be transmitted, the stamp surface being meltable and fusable to produce a melted-fused portion which blocks transmission of ink therethrough;

a support body having a support surface that supports the stamp plate from the backside surface of the stamp plate;

a backside reinforcement detachably disposed between the stamp plate and the support body, the backside reinforcement holding the stamp plate: and at least one protrusion that detachably holds the stamp plate with respect to the support body, the at least one protrusion being fixed to one of the backside reinforcement and the support body and engaging with another one of the backside reinforcement and the support body.

14. The stamp unit as claimed in claim 13 wherein the at least one protrusion defines holding members penetrating into at least one of the backside surface of the stamp plate and the support surface of the support member to detachably hold the stamp plate to the support body, the holding members comprising:

mortises formed in one of the support surface of the support body and the backside surface of the stamp plate so as to extend in parallel rows thereacross; and tenons engaging in the mortises and formed in the other of the support surface of the support body and the backside surface of the stamp plate so as to extend in parallel rows thereacross.

15. The stamp unit as claimed in claim 13 wherein:

the stamp plate has a shape and is formed with a hole; and the support body is formed with a recess having a shape complementary of the stamp plate inserted in the recess, the support body being formed with the at least one protrusion on a base of the recess at a position corresponding to the hole in the stamp plate so that the at least one protrusion protrudes into the hole of the stamp plate.

16. A stamp unit as claimed in claim 13, wherein the support body is formed with a through hole and the backside reinforcement is formed with the protrusion fitting in the through hole, a tip end of the protrusion being exposed via the through hole.

* * * * *